US010004366B2

(12) United States Patent
Chalko et al.

(10) Patent No.: US 10,004,366 B2
(45) Date of Patent: Jun. 26, 2018

(54) DISPENSING SYSTEM

(71) Applicant: Kimberly-Clark Worldwide, Inc., Neenah, WI (US)

(72) Inventors: Eric M. Chalko, Alpharetta, GA (US); Klemen Erzen, Preddvor (SI); Randall W. LeCates, Monroeville, NJ (US); David Kapiloff, Gainesville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days. days.

(21) Appl. No.: 15/503,551

(22) PCT Filed: Feb. 29, 2016

(86) PCT No.: PCT/US2016/020026
§ 371 (c)(1),
(2) Date: Feb. 13, 2017

(87) PCT Pub. No.: WO2017/151088
PCT Pub. Date: Sep. 8, 2017

(65) Prior Publication Data
US 2018/0116473 A1 May 3, 2018

(51) Int. Cl.
*A47K 10/42* (2006.01)

(52) U.S. Cl.
CPC ..... *A47K 10/422* (2013.01)

(58) Field of Classification Search
CPC .... A47K 10/422; A47K 10/427; A47K 10/42; A47K 10/44; A47K 10/20; B65H 1/26; B65D 83/08; F42C 7/10
USPC ..... 221/251, 33–63
See application file for complete search history.

(56) References Cited

U.S. PATENT DOCUMENTS

| | | | | |
|---|---|---|---|---|
| 3,777,931 | A * | 12/1973 | Fleming | A47K 10/422 221/227 |
| 4,094,442 | A | 6/1978 | Radek | |
| 4,311,252 | A * | 1/1982 | Hope, Jr. | A47K 10/422 221/57 |
| 6,331,696 | B1 * | 12/2001 | Nakamura | A47K 10/422 219/386 |
| 2012/0305586 | A1 | 12/2012 | Taylor | |
| 2018/0000261 | A1 * | 1/2018 | Smith | A47F 1/10 |

FOREIGN PATENT DOCUMENTS

| | | |
|---|---|---|
| EP | 1 656 870 A2 | 5/2006 |
| EP | 2 850 986 A2 | 3/2015 |

* cited by examiner

*Primary Examiner* — Timothy R Waggoner

(57) ABSTRACT

Methods, systems and apparatus for dispensing paper product, such as folded towels, and having a dispensing mechanism that restricts the movement of the product holding platform during replenishment (e.g., when the dispenser lid is open) and allows free movement of the platform when dispensing (e.g., when the dispenser lid is closed).

13 Claims, 6 Drawing Sheets

DISPENSING SYSTEM

BACKGROUND

This disclosure relates to dispensing systems for use with, for example, products such as hand and facial towels and tissues.

Systems dispensing consumable products are ubiquitous in many environments today. For example, countertop hand towel dispensers are commonplace in many private, semi-private and public washrooms and break rooms. Such dispensers can provide folded hand towels to users, for example, to dry their hands. Some countertop dispensers use a spring-loaded tray to bias the towel stack up towards the dispenser opening to ease user access to the towels and facilitate dispensing. However, such a tray can make replenishing the towels a challenge as the maintenance attendant must juggle keeping the tray pushed down while simultaneously trying to close the lid of the dispenser after the refill.

SUMMARY

In general, the subject matter of this specification relates to dispensing systems (e.g., for hand and facial towels and tissues) that provide a mechanism to facilitate loading, refilling and monitoring product.

In general, one aspect of the subject matter described in this specification can be implemented in systems that include a dispensing system comprising a housing comprising a lower portion, an upper portion and an interior, where the lower portion defines a bottom and sides for the interior, and the upper portion defines a top for the interior and is configured to have (i) a closed position in which the upper portion is proximate to the sides and (ii) an open position in which the upper portion is distal from one or more of the sides; a product holding device at least partially within the housing and configured to hold product; a biasing device engaged to the product holding device and configured to bias the product holding device away from the bottom; and a dispensing mechanism at least partially within the housing and configured to facilitate movement of the product holding device along a vertical length between the top and the bottom, wherein the dispensing mechanism has one or more retention devices each disposed along the length at a different vertical position, and where in response to the upper portion being in the open position, each of the one or more retention devices is configured to move to a first position to separately and sequentially engage the product holding device at its respective vertical position to (i) permit the product holding device to be moved down towards the bottom past its respective vertical position and (ii) prevent the biasing device from moving the product holding device up, away from the bottom, above its respective vertical position once the product holding device has been moved below its respective vertical position, and in response to the upper portion being in the closed position, each of the one or more retention devices is configured to move to a second position to disengage from the product holding device to permit the product holding device to be moved up by the biasing device above its respective vertical position. Other embodiments of this aspect include corresponding methods and apparatus.

Yet another aspect of the subject matter described in this specification can be implemented in a dispensing system comprising a housing comprising a lower portion, an upper portion and an interior, wherein the lower portion defines a bottom and sides for the interior, and the upper portion is hinged to the lower portion and defines a top for the interior and is configured to have (i) a closed position in which a perimeter of the upper portion engages substantially all of the sides and (ii) an open position in which the upper portion does not engage substantially all of the sides; a product holding platform at least partially within the housing and configured to hold product; a biasing device engaged to the product holding platform and configured to bias the product holding platform away from the bottom; and a dispensing mechanism comprising two vertically oriented shafts and configured to manage vertical movement of the product holding platform along a vertical length between the top and the bottom, wherein each of the vertically oriented shafts comprises a plurality of retention devices, each disposed along a length of the respective shaft at a different vertical positions and in vertical alignment, and where in response to the upper portion being in the open position, each of the plurality of retention devices is configured to move to a first position to sequentially engage the product holding platform at its respective vertical position as the product holding platform moves up and down along the vertical shafts to (i) permit the product holding platform to move unobstructed down past its respective vertical position and (ii) prevent the biasing device from moving the product holding platform up above its respective vertical position once the product holding platform has been moved below its respective vertical position, and in response to the upper portion being in the closed position, each of the plurality of retention devices is configured to move to a second position to disengage from the product holding platform to permit the product holding device to be moved up by the biasing device unobstructed above its respective vertical position. The biasing device can be a coiled spring mounted between the bottom and the product holding device. Other embodiments of this aspect include corresponding methods and apparatus.

In some implementations, the methods, systems, and apparatus described herein have the following features. The upper portion is a lid hinged on one of the sides defined by the lower portion. Each retention device has a downwardly sloped top surface and a horizontally flat bottom surface and the product holding device has horizontal spring components that retract inwardly as the product holding device moves down across the sloped top surface of each of the one or more retention devices, when in the first position, and extend back outwardly as product holding device moves down past the sloped top surface to the horizontally flat bottom surface. The first position is a position where the downwardly sloped top surface extends toward a center of the interior and the second position is a position where the downwardly sloped top surface extends toward one of the sides away from the center.

The dispensing mechanism includes two vertical shafts on opposite sides of the interior and the retention devices comprise a first set of retention devices on a first of the two vertical shafts and a second set of retention devices on a second of the two vertical shafts. The two vertical shafts rotate around vertical axes to move the retention devices from the first position to the second position and back.

The dispensing mechanism includes two rotation prongs, each vertically oriented in alignment with respective ones of the two vertical shafts and configured to engage the vertical shafts only in the closed position and disengage the vertical shafts in the open position, wherein such engagement in the closed position rotates the two vertical shafts to the second position. The upper portion is configured to engage the two rotation prongs in the closed position to cause the rotation prongs to engage the vertical shafts.

The dispensing mechanism includes disengagement springs mounted between the two vertical shafts and the two rotation prongs and are configured to disengage the two vertical shafts from the two rotation prongs in the open position. The dispensing system can include two vertical shafts that slide horizontally to move the retention devices from a position of engaging the product holding device to a position of not engaging the product holding device, and back.

The dispenser system can include an overstuff prevention device engaged to the dispensing mechanism, where, in the open position, the overstuff prevention device is in a prevention position that prevents the product holding device from moving below a threshold distance from the bottom and, in the closed position, moves to a non-prevention position that does not restrict the product holding device moving below the threshold distance. The dispenser system can include a dispensing mechanism biasing device configured to bias the one or more retention devices to the first position, and a refill indicator that indicates the amount of product remaining in the dispenser.

Particular embodiments of the subject matter described in this specification can be implemented so as to realize one or more of the following advantages. For example, the when the dispenser lid is open (e.g., to refill the dispenser), the tray holding the towels can be pushed down to load more towels and is prevented, by a dispensing mechanism, from moving back up (e.g., from the force of the tray spring) and pushing the towels out of the dispenser during the refill process. When the lid is (subsequently) closed, the dispensing mechanism no longer restricts the holding tray's upward movement. This allows the spring to push the tray up towards the dispenser opening to allow users ready access to the towels and facilitate dispensing (e.g., as the towels are pushed up proximate to the dispenser opening so that the users don't have reach far down into the dispenser opening to get a towel).

In some scenarios when an attendant is refilling the dispenser the attendant overstuffs the dispenser (e.g., inserts too many paper towels into the dispenser making the towel stack too high) such that when the lid is closed the top of the towel stack presses against the bottom of the lid with such force that it makes it difficult for a user to remove a towel through the dispenser opening. The present dispenser system includes an overstuff prevention device that restricts the number of towels that can be inserted into the dispenser (e.g., by preventing the holding tray, and thereby the towel stack, from going all the way to the bottom of the dispenser) with the lid open. And when the lid is closed, the overstuff prevention device allows the holding tray to move further down (than it could with the lid open) such that the extra space at the bottom reduces the pressure between the top of the towel stack and the bottom of the lid to ease dispensing.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The present disclosure relates to a dispenser to dispense, for example, towels, napkins, facial tissue and the like. The dispenser includes a biasing device, for example, a spring, that pushes a holding tray, on which the towels are placed, up towards the dispenser opening in the dispenser lid. Thus, with the lid open and as towels are loaded into the dispenser, the holding tray is pushed down into the interior of the dispenser to make room for the towels. During this process the biasing device continues to push up on the tray to force the towels out of the dispenser, which facilitates the dispensing process when the lid is closed but works against the attendant when loading towels with the lid open.

As such, when the lid is open, the dispensing mechanism prevents the towel holding tray from moving up during the refilling process, whether partially or fully loaded. In turn, when the lid is closed, the dispensing mechanism allows the tray to freely move up towards the dispenser opening in the lid to aid dispensing by making the towels readily accessible through the dispenser opening. The dispenser is described in more detail with reference to FIGS. 1 and 2.

Figure 1:
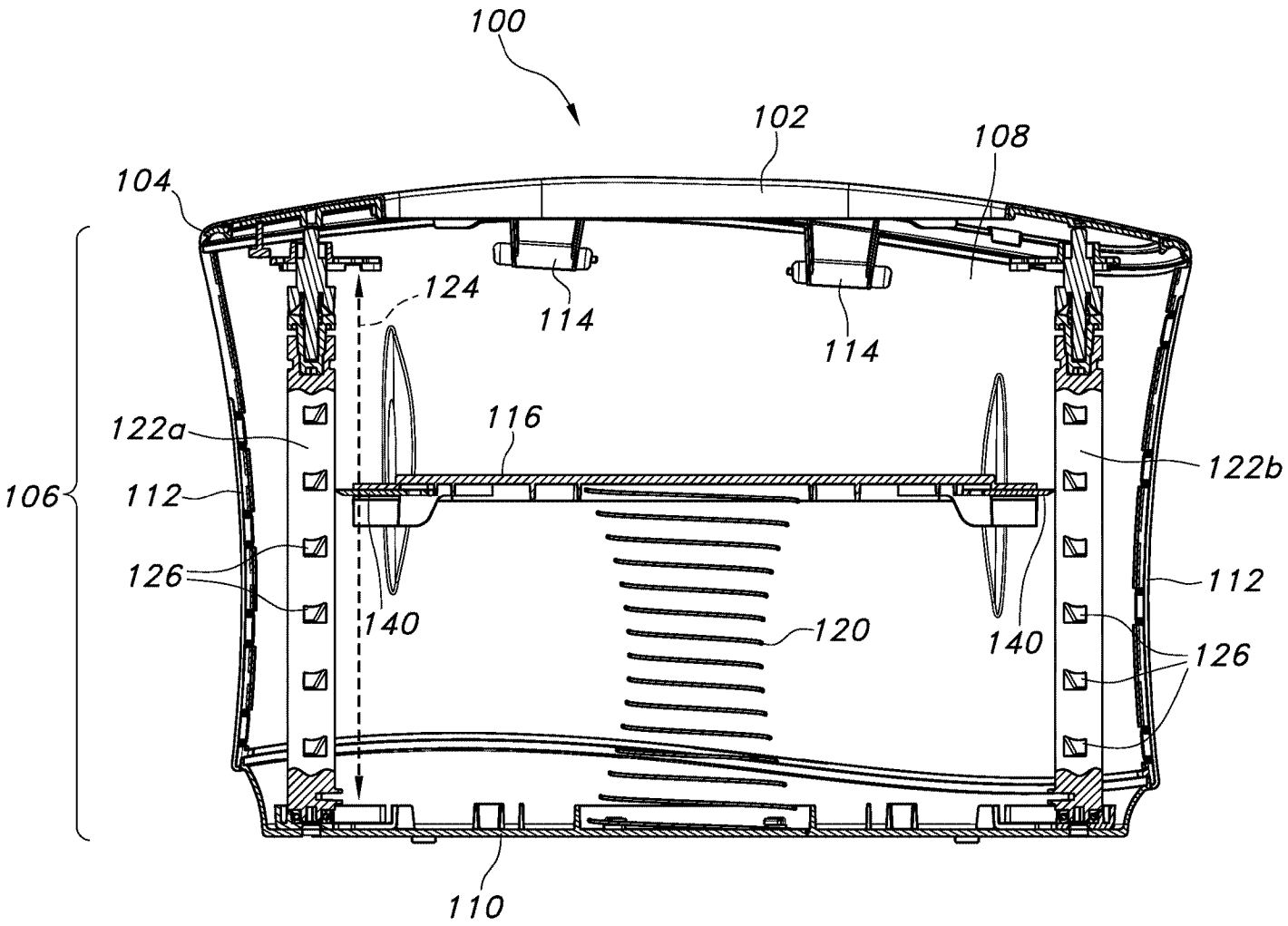
FIG. 1 is a cross sectional view of the dispenser system with the lid closed.
Figure 2:
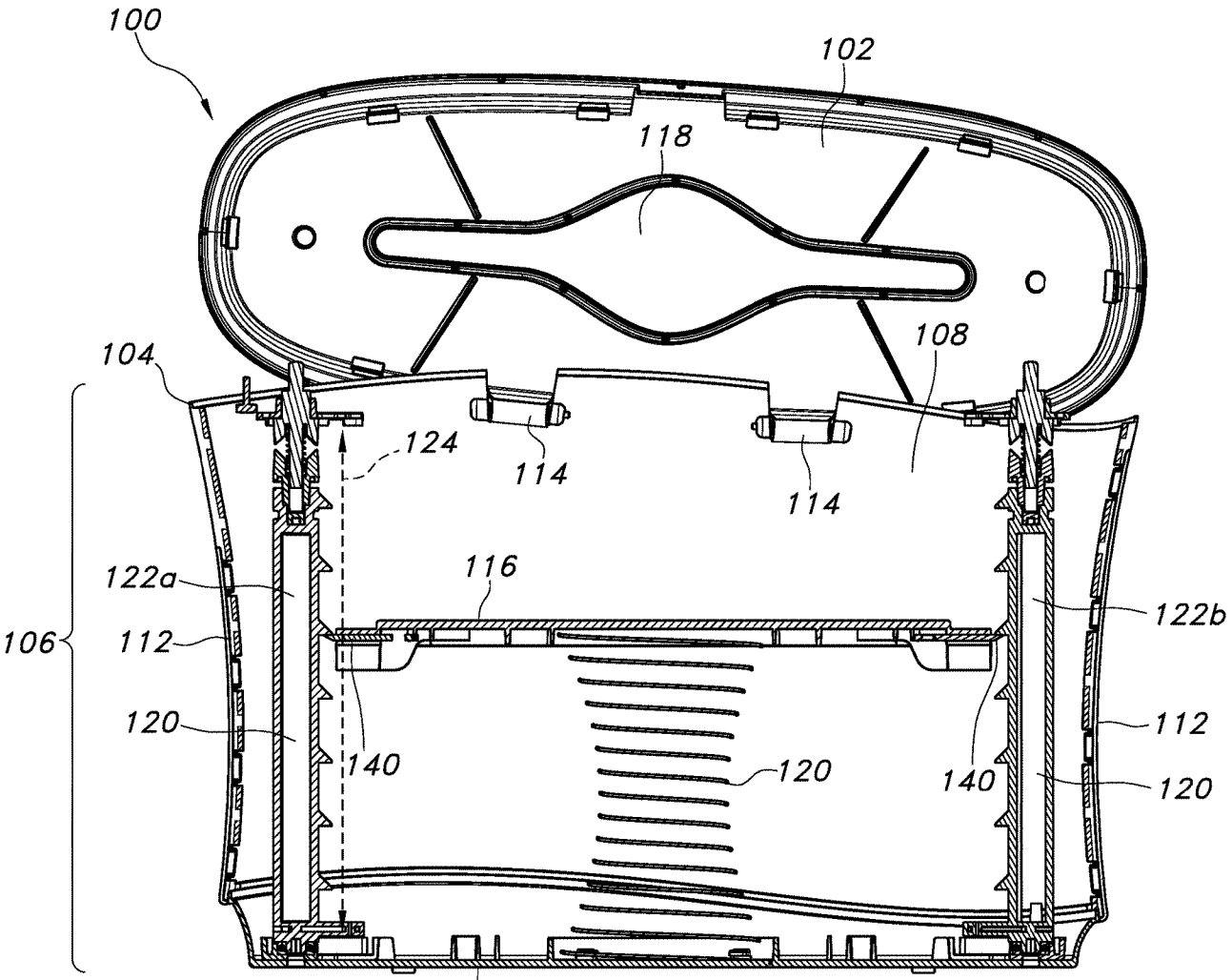
FIG. 2 is a cross sectional view of the dispenser system with the lid open.

FIG. 1 is a cross sectional view of the dispenser system 100 with the lid 102 closed. FIG. 2 is a cross sectional view of the dispenser system 100 with the lid 102 open. More specifically, the dispenser system 100 includes a housing 104 with a lower portion 106, an upper portion 102 (e.g., the lid 102) and an interior 108. In some implementations the dispenser system 100 is a folded hand towel dispenser or a napkin or facial tissue dispenser and the housing 104 is formed from a plastic, metallic or composite material.

The lower portion 106 defines the bottom 110 and sides 112 of the housing 100 and the upper portion 102 defines the top of the housing 104 (e.g., the top of the housing when the upper portion is in the closed position). The interior 108 is the open space or cavity within the housing 104 defined (e.g., bounded) by the bottom 110, sides 112 and top or lid 102. The lid has an opening 118, as shown in FIG. 2, through which product can be dispensed (e.g., pulled out by a user). In some implementations where the housing 102 has a rectangular or oval shape, the housing has four sides 112 (e.g., left, right, front and back).

As mentioned above, the upper portion 102 can have an open and a closed position. In some implementations, the upper portion 102 is attached to the lower portion 106 by a hinge 114 (e.g., mounted on the interior or exterior sides 112 of housing 104) to allow the upper portion to pivot up on the hinge 114 away from the interior 108 to allow access to the interior 108 (e.g., for refilling with hand towels). As such, in the open position the upper portion 102 (e.g., other than the section of the upper portion 102 connected to the hinge 114) is distal from one or more of the sides 112, as shown in FIG. 2. In some implementations, the upper portion 102 is completely removable from the lower portion 106 and engages to the lower portion 106, for example, by a friction or snap fit.

In some implementations, as shown in FIG. 1, the closed position is when the upper portion 102 is proximate to the sides 112 (e.g., engaged to or touching all or a majority of the sides 112). For example, in implementations with a hinge 114, the upper portion 102 is held to the lower portion 106 in the closed position, for example, by a lock or a friction or snap fit (e.g., opposite the hinge 114).

The dispenser system 100 also includes a product holding device 116 (or product holding platform) positioned at least partially within the housing 104, which holds product(s) such as, for example, folded paper hand towels, napkins or facial tissue. In some implementations, the product holding device 116 is a flat, horizontal tray 116 (e.g., that rides on or between vertical guides in the housing 104). Product is stacked or placed on the device 116. The device 116 can move vertically up and down between the top 102 and the bottom 110. When the system 100 is fully filled with product, the device 116 is near the bottom 110 and when the system 100 is depleted or nearing depletion (e.g., almost all of the towels have been used) the device 116 is near the top 102.

The dispenser system 100 includes a biasing device 120 engaged to the product holding device 116 that biases the product holding device 116 away from the bottom 110 towards the top 102. In some implementations, the biasing device 120 is a spring 120 mounted between the bottom 110 of the housing 104 and the underside of the product holding device 116 such that the spring 120 resists movement of the device 116 towards the bottom 110 and pushes the device 116 towards the top 102. For example, the spring 120 could be a compression, coil or ribbon spring. In some implementations, there can be multiple springs or other biasing devices used to bias the product holding device 116. For example, there could be a spring 120 on each side of the device 116 and the springs 120 (or spring if only one is used) could be mounted on the housing near the top 102 to pull the device 116 up, as opposed to push the device 116 from underneath.

The dispensing mechanism 122 controls the movement of the product holding device 116. The dispensing mechanism 122 is located within (and connected to) the housing 104. The dispensing mechanism 122 facilitates the movement of the product holding device 116 along a vertical length 124 (as shown in FIG. 2) between the top 102 and the bottom 110.

In some implementations the dispensing mechanism 122 has one or more retention devices 126 disposed along its length (e.g., parallel to the vertical length 124) with each retention device 126 located a different vertical position along the length, as shown in FIGS. 1 and 2. As described in more detail below and depending on whether the lid/top 102 is open or closed, the retention devices 126 either restrict or freely allow the upwards movement (e.g., towards the top 102) of product holding device 116.

In some implementations, the dispensing mechanism 122 has two vertical shafts or guides 122*a* and 122*b* positioned on opposing sides of the interior 108 (although in some implementations the dispensing mechanism only has one such shaft or guide). Each shaft 122*a* and 122*b* has a vertical row of retention devices positioned along its length and vertically aligned with each other. As described below, each shaft 122*a* and 122*b* rotates around its vertical axis in response to the position of the lid 102, e.g., open or closed, to allow the retention devices 126 to either engage or disengage from the product holding device 116 to control the vertical movement of the device 116.

In some implementations, in response to the upper portion 102 being in the open position (as shown in FIG. 2) the retention devices 126 move to a first position (e.g., facing the interior 108 or center of the dispenser 100) such that the retention devices 126 can engage the product holding device 116 as it moves up and down. Thus, depending on the vertical position of the product holding device 116, each retention device 126, e.g., on shaft 122*a* or 122*b*, separately and sequentially engages the product holding device 116 at its respective vertical position to (i) permit the product holding device 116 to be moved down towards the bottom 110 past its respective vertical position and (ii) prevent the biasing device 120 from moving the product holding device 116 up, away from the bottom 110, above its respective vertical position once the product holding device 116 has been moved below its respective vertical position.

In response to the upper portion 102 being in the closed position (as shown in FIG. 1), the retention devices 126 move to a second position (e.g. away from the center of the dispenser) to disengage from the product holding device 116 to permit the product holding device 116 to be moved up by the biasing device 120 above each retention device's respective vertical position. Thus, in some implementations, in the second position, the retention devices 126 rotate such that they no longer engage the product holding device 116.

Figure 4:
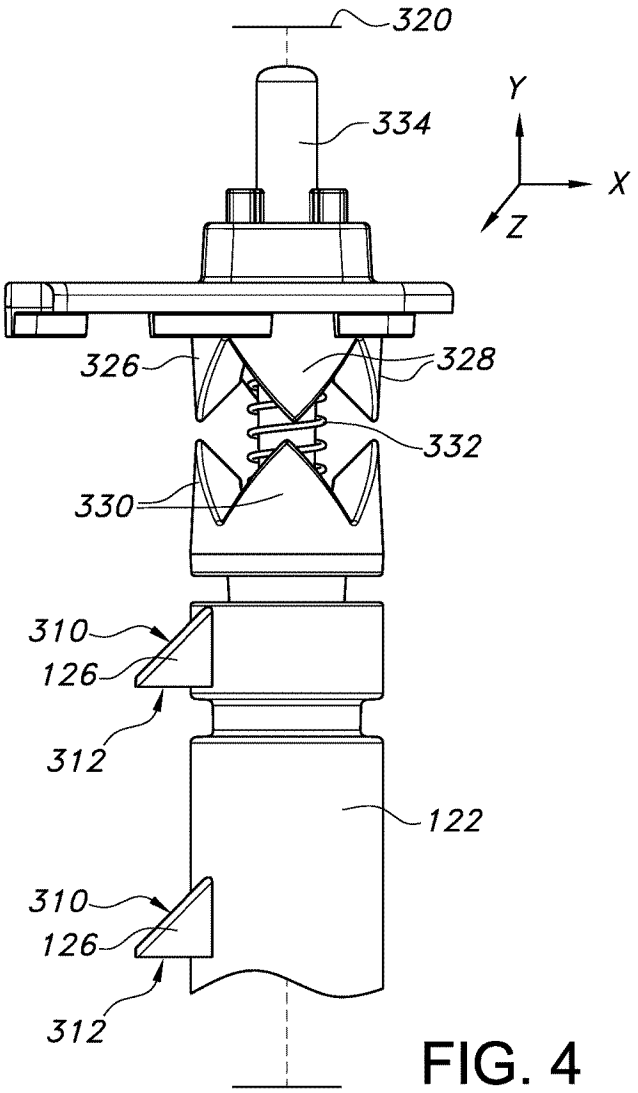
FIG. 4 is a partial view of the dispensing mechanism with the lid open.
Figure 3:
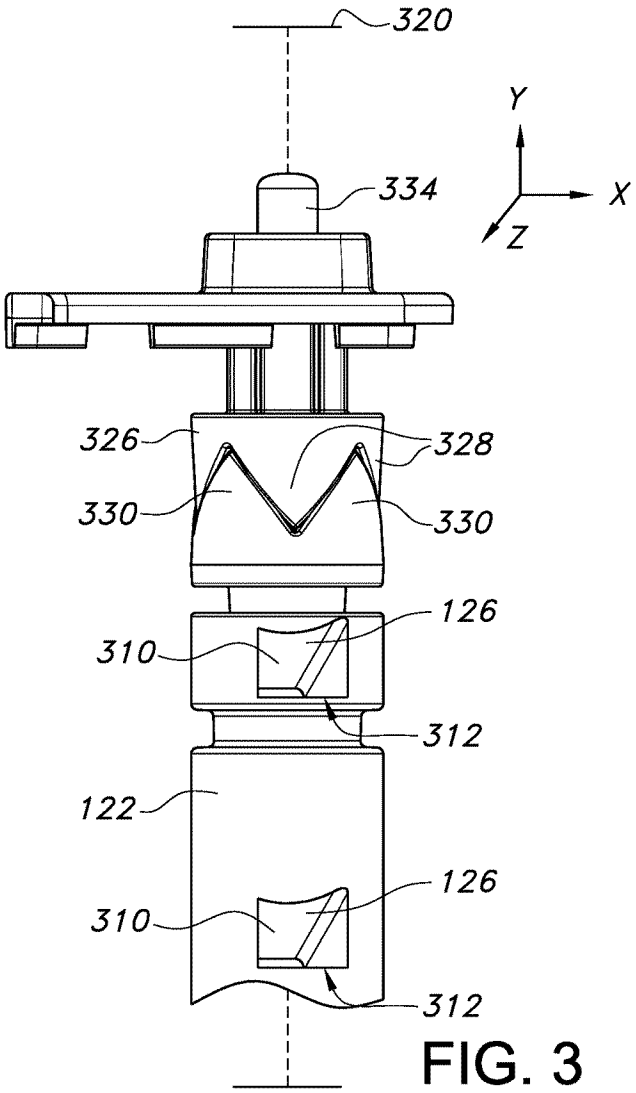
FIG. 3 is a partial view of the dispensing mechanism with the lid closed.

FIG. 3 is a partial view of the dispensing mechanism 122 with the lid 102 closed and FIG. 4 is a partial view of the dispensing mechanism 122 with the lid 102 open. In some implementations, each retention device 126 has a downwardly sloped top surface 310 and a horizontally flat bottom surface 312 and the retention devices 126 are mounted on vertical shafts (e.g., shafts 122*a, b*) on opposite sides of the interior 108. For example, the retention devices 126 can be grouped into a first set of retention devices on a first of the two vertical shafts 122*a* and a second set of retention devices 126 on a second of the two vertical shafts 122*b*.

In some implementations, the product holding device 116 has horizontal spring components 140 (as shown in FIGS. 1 and 2) that retract inwardly (e.g., towards the center of the interior 108) as the product holding device 116 moves down across the sloped top surface 310 of each retention device 126 (e.g., as occurs during refilling), when in the first position, and extend back outwardly (e.g., away from the center of the interior 108) as product holding device 116 moves down past the sloped top surface 310 to the horizontally flat bottom surface 312. This allows the product holding device 116 to move down past that retention device 126. This process is repeated at each retention device 126 along the shaft 122 (e.g., for each set of retentions devices 126 along their respective shaft 122). In some implementations, the first position is a position where the downwardly sloped top surface 310 extends toward a center of the interior 108 and the second position is a position where the downwardly sloped top 310 surface extends toward one of the sides 112 away from the center of the interior 108 (or is rotated away from the product holding device 116 such that the retention devices 126 do not engage the product holding device 116 as the device 116 moves up and down through its normal operation). For example, the vertical shafts 122 can rotate around vertical axes 320 (e.g., along the y axis) to move the respective set of retention devices 126 from the first position to the second position and back.

The sloped top surface 310 defines a decline with its highest point towards the lid 102 and proximate the shaft 122, and its lowest point towards the bottom 110 and distal from the shaft 122. Thus when the biasing device 120 tries to push the product holding device 116 up towards the lid 102, the horizontal spring components 140 engage the flat bottom surface 312 of the respective retention device 126, which prevents the upward movement of the device 116 because the flat bottom surface 312 does not cause the spring component 140 to retract (e.g., because it is not sloped or inclined). As such, it cannot readily move above the respective retention device 126.

In some implementations, other types of retention devices 126 can be used. For example, each retention device 126 can be a detent that allows downward movement with sufficient force from an operator during a refill. But the biasing device 120 does not generate enough force to push the product holding device 116 past such a detent (or pair of detents if each vertical shaft 122 has corresponding detents).

As discussed above, in some implementations, the shafts 122 rotate to move the retention devices 126 between the first position (when the lid 102 is open) as shown in FIG. 4 and second position (when the lid is closed) as shown in FIG. 3. When in the second position the retention devices 126 do not engage the product holding device 116 and when in the first position the retention devices 126 engage the product holding device 116.

In some implementations the dispensing mechanism 122 has two rotation prongs 326. Each prong 326 is vertically oriented in alignment with its respective vertical shaft 122 and engages its vertical shaft 122 only in the closed position and disengages (i.e., does not engage) its vertical shaft 122 in the open position. When the prongs 326 are engaged to their respective vertical shafts 122 (in the closed position) the prongs cause the shafts 122 (and hence the retention devices 126) to rotate to the second position so that the retention devices 126 can disengage from the product holding device 116.

In some implementations the prongs 326 include teeth 328 that match, but are rotationally offset from, teeth 330 on the shafts 122. The teeth 328 and teeth 330 are biased apart by, for example, a spring 332.

The prongs 326 include or are engaged by arms 334 that are moved (e.g., pressed on) by the lid 102 such that when the lid 102 is closed the arms 334, in turn, push down on the teeth 328 to overcome the bias of the disengagement springs 332 to engage teeth 328 to teeth 330. In some implementation the prongs 326 are rigidly mounted such that they do not rotate, but only move up and down. Thus, for example, when the teeth 328, which are rotationally offset from and vertically aligned with the teeth 330, the engagement of the teeth 328 and teeth 330 causes the shafts 122 to rotate to the second position. When the lid 102 is opened and the spring 332 (e.g., coiled spring) separates teeth 328 and teeth 330 the shafts 122 rotate back to the first position, as in some implementations the shafts 122 are biased (e.g., return) to the first position, for example, by a spring or the like.

In this way the opening and closing of the lid 102 causes the shafts 122, and hence the retention devices 126, to move been the first and second positions to control the vertical movement of the product holding device 116.

In some implementations, the two vertical shafts 122 slide horizontally to move the one or more retention devices 126 from a position of engaging the product holding device 116 to a position of not engaging the product holding device 116, and back, which respectively prevents or allows the product holding device 116 to move up and down. For example, the shafts 122 slide along tracks at the bottom 110 of the dispenser 100 that run from the respective sides 112 towards the interior 108. When the lid 102 is open the shafts 122 are positioned along the tracks (e.g., towards the interior 108) such that they engage the product holding device 116. Conversely, when the lid 102 is closed the shafts 122 are positioned along the tracks (e.g., towards the exterior 112) such that they do not engage the product holding device 116. In some implementations the retention devices 126 face towards the center of the interior 108 whether the lid 102 is open or closed, e.g., they do not rotate about the shafts 122 as they move along the tracks and remain pointed towards the product holding device 116 regardless of the lid 102 position.

Figures 5, 5A:
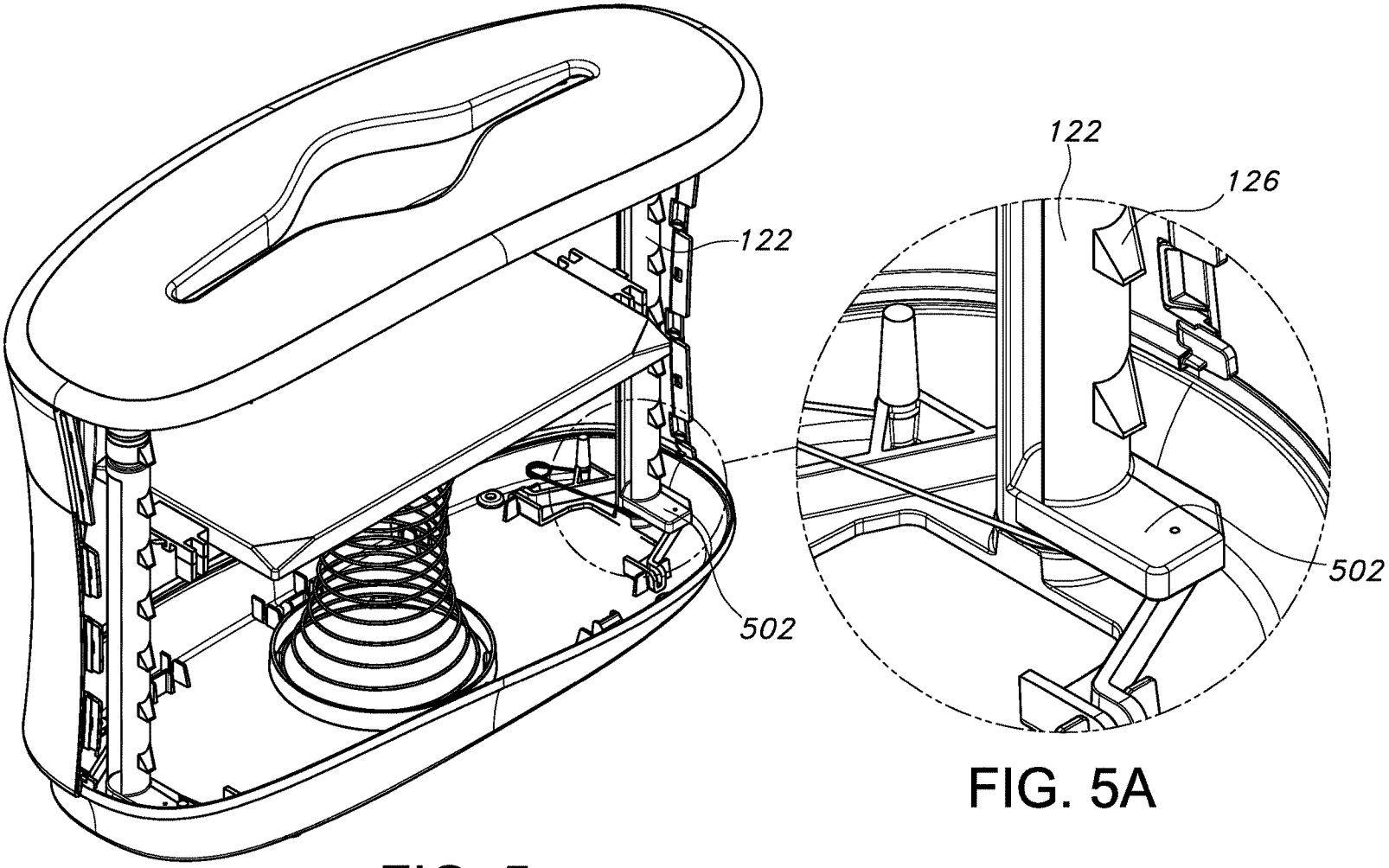
FIG. 5 is a perspective cut-away view of the dispenser system with the lid closed.
FIG. 5A is a detailed view of the overstuff prevention device from FIG. 5.
Figure 6A:
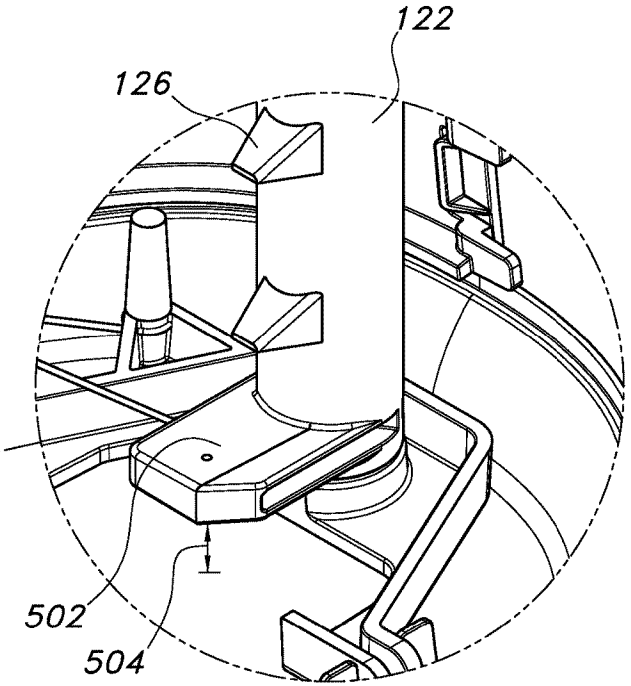
FIG. 6A is a detailed view of the overstuff prevention device from FIG. 6.
Figure 6:
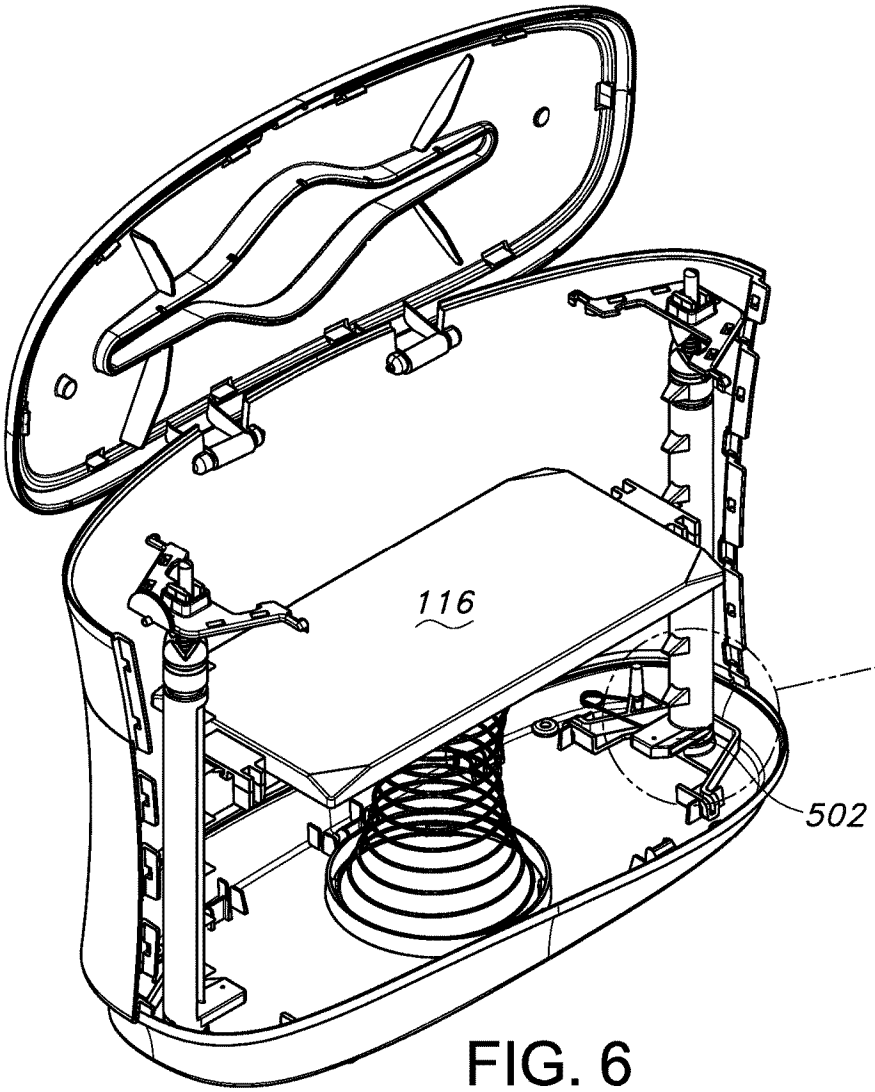
FIG. 6 is a perspective cut-away view of the dispenser system with the lid open.

In some implementations, the dispenser 100 includes an overstuff prevention device 502 as shown in FIGS. 5, 5A, 6 and 6A, which are respectively are a perspective cut-away view of the dispenser system 100 with the lid 102 closed, a detailed view of the overstuff prevention device 502 from FIG. 5A, a perspective cut-away view of the dispenser system 100 with the lid 102 open, and a detailed view of the overstuff prevention device 502 from FIG. 6A.

In some implementations, the overstuff protection device 502 is engaged to the dispensing mechanism 122. For example, there can be one overstuff prevention device 502 proximate the bottom of each shaft 122 or there can be one overstuff prevention device 502 on the left of right shaft 122. The overstuff prevention device 502, for example, can be a foot or protrusion at or near the bottom of the shaft 122, and rotates as the shaft 122 rotates or otherwise moves. The overstuff prevention device 502 is aligned with the respective retention devices 126 on the shaft 122 such that when the lid 102 is open, the overstuff prevention device 502 is positioned to extend out towards the center of the interior 108 (e.g., prevention position as shown in FIG. 6A) and prevent or stop the product holding device 116 from going all the way to the bottom 110 (e.g., leaving space or threshold distance 504 between the product holding device 116 and the bottom 108).

Likewise, when the lid 102 is closed, the overstuff prevention device 502 rotates or moves to or is in a non-prevention position (e.g., as shown in FIG. 5A) such that it does not prevent the product holding device 116 from going all the way down to the bottom 110 (e.g., the product holding device 116 can move into the space 504 or go below the threshold distance 504).

As described above, the overstuff prevention device 502, when in the prevention position, stops the product holding device 116 from moving all the way to the bottom 110. Thus, when the lid 102 is open, for example, to refill the dispenser 100 with paper towels, the service attendant cannot force the device 116 below the threshold distance 504 and add the extra towels that would be possible if the device 116 could go all the way to the bottom 110 (e.g., below the threshold distance 504). When the lid 102 is closed it presses down on the towel stack on the device 116 and creates pressure on the towel stack. If there is too much pressure on the towel stack (e.g., by trying to make the towel stack too large/tall given the towel capacity of the dispenser 100, "overstuffing") it may not dispenser properly as it may be too difficult to pull a towel from the stack through the opening 118 or the towel may tear during this process by the friction/pressure between the towel stack and the underside of the lid 102. Overstuffing is a common problem as service attendants are inclined to add as many towels as possible because it reduces the number of times the dispenser 100 must be refilled, which reduces the number of service visits and associated costs.

The overstuff prevention device 502, when the lid 102 is closed, allows the device 116 to move below the threshold distance 504. This extra space reduces the pressure on the towel stack to facilitate dispensing.

Figure 7:
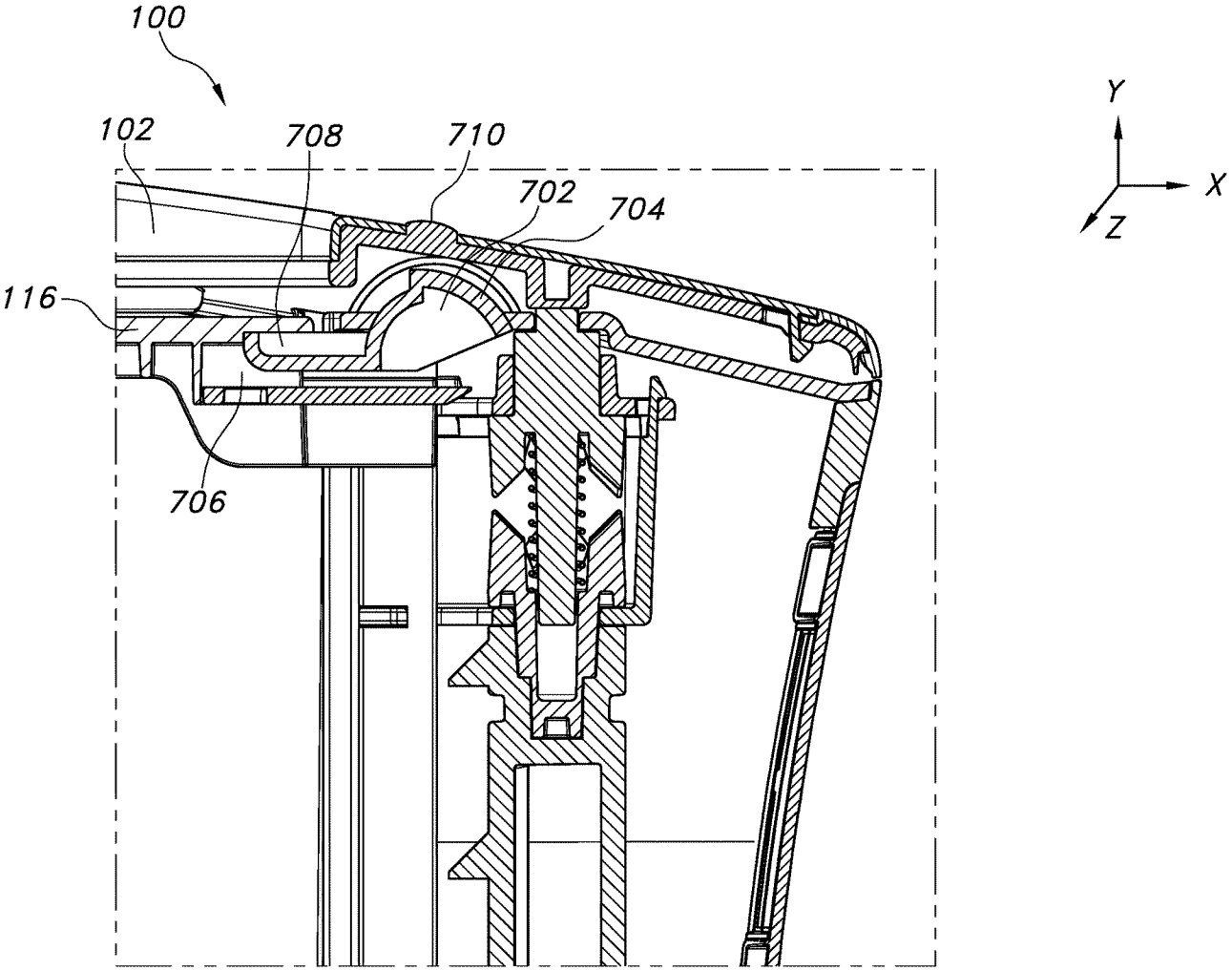
FIG. 7 is a cross section view of another embodiment of the dispenser system showing a refill indicator.

In some implementations, the dispenser 100 includes a refill indicator, as shown in FIG. 7, which is a cross section view of the dispenser system 100 showing the refill indicator 702. The refill indictor 702 is a device that visually or audible indicates that the dispenser 100 is nearing or is depleted of towels (or other product the dispenser 100 may be dispensing). For example, the refill indicator 702 includes an indicator wheel or graphic 704 visible through the lid 102 (e.g., at a viewing window 710) that is controlled by the product holding device 116 (e.g., through a set of gears or teeth or the vertical movement of the device 116) such that when the device 116 moves further towards the lid 102 (indicating that the towels are being depleted) it causes the indictor wheel/graphic 704 to move or rotate to show that a refill is needed. In some implementations, the indicator wheel/graphic 704 has zones to that indicate the towel stack is full (e.g., green color), nearing depletion (e.g., orange) or depleted (e.g., red) or subzones in between.

As shown in FIG. 7 the refill indicator 702 can rotate about the z axis (e.g., into the drawing figure). With the device 116 near the bottom 110 refill indicator 702 is weighted or biased such that the indicator wheel/graphic 704 indicates no refill is needed. As the device 116 moves up towards the lid 102 (e.g., as towels are used) an edge 706 of the device 116 (e.g., spring 140) engages a lip 708 of the refill indicator 702 and causes the indicator wheel/graphic 704 to rotate as the device 116 moves up. The indicator wheel/graphic 704 is coordinated with the upward movement of the device 116 such that is changes accordingly (e.g., based on the vertical position of the device 116) to indicate how much of the towel stack remains and correspondingly if a refill is needed via changing the indication on the indicator wheel/graphic 704 seen through the window 710.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A dispensing system comprising:

a housing comprising a lower portion, an upper portion and an interior, wherein the lower portion defines a bottom and sides for the interior, and the upper portion defines a top for the interior and is configured to have (i) a closed position in which the upper portion is proximate to the sides and (ii) an open position in which the upper portion is distal from one or more of the sides;

a product holding device at least partially within the housing and configured to hold product;

a biasing device engaged to the product holding device and configured to bias the product holding device away from the bottom; and a dispensing mechanism at least partially within the housing and configured to facilitate movement of the product holding device along a vertical length between the top and the bottom, wherein the dispensing mechanism comprises two vertical shafts on opposite sides of the interior and one or more retention devices each disposed along the length at a different vertical position, the one or more retention devices comprising a first set of retention devices on a first of the two vertical shafts and a second set of retention devices on a second of the two vertical shafts, and wherein:

in response to the upper portion being in the open position, each of the one or more retention devices is configured to move to a first position to separately and sequentially engage the product holding device at its respective vertical position to (i) permit the product holding device to be moved down towards the bottom past its respective vertical position and (ii) prevent the biasing device from moving the product holding device up, away from the bottom, above its respective vertical position once the product holding device has been moved below its respective vertical position, and in response to the upper portion being in the closed position, each of the one or more retention devices is configured to move to a second position to disengage from the product holding device to permit the product holding device to be moved up by the biasing device above its respective vertical position, and wherein the the two vertical shafts are configured to rotate around vertical axes to move the one or more retention devices from the first position to the second position and back.

2. The dispensing system of claim 1, wherein each of the one or more retention devices has a downwardly sloped top surface and a horizontally flat bottom surface and the product holding device has horizontal spring components that retract inwardly as the product holding device moves down across the sloped top surface of each of the one or more retention devices, when in the first position, and extend back outwardly as product holding device moves down past the sloped top surface to the horizontally flat bottom surface.

3. The dispensing system of claim 2, wherein the first position is a position where the downwardly sloped top surface extends toward a center of the interior and the second position is a position where the downwardly sloped top surface extends toward one of the sides away from the center.

4. The dispensing system of claim 1, wherein the dispensing mechanism comprises two rotation prongs, each vertically oriented in alignment with respective ones of the two vertical shafts and configured to engage the vertical shafts only in the closed position and disengage the vertical shafts in the open position, wherein such engagement in the closed position rotates the two vertical shafts to the second position.

5. The dispensing system of claim 4, wherein the upper portion is configured to engage the two rotation prongs in the closed position to cause the rotation prongs to engage the vertical shafts.

6. The dispensing system of claim 5, wherein the dispensing mechanism comprises disengagement springs mounted between the two vertical shafts and the two rotation prongs and are configured to disengage the two vertical shafts from the two rotation prongs in the open position.

7. The dispensing system of claim 1, wherein the biasing device is a coiled spring mounted between the bottom and the product holding device.

8. The dispensing system of claim 1, further comprising an overstuff prevention device engaged to the dispensing mechanism, wherein, in the open position, the overstuff prevention device is in a prevention position that prevents the product holding device from moving below a threshold distance from the bottom and, in the closed position, moves to a non-prevention position that does not restrict the product holding device moving below the threshold distance.

9. The dispensing system of claim 1, wherein the upper portion is a lid hinged on one of the sides defined by the lower portion.

10. The dispensing system of claim 1 further comprising a dispensing mechanism biasing device configured to bias the one or more retention devices to the first position.

11. A dispensing system comprising:

a housing comprising a lower portion, an upper portion and an interior, wherein the lower portion defines a bottom and sides for the interior, and the upper portion is hinged to the lower portion and defines a top for the interior and is configured to have (i) a closed position in which a perimeter of the upper portion engages substantially all of the sides and (ii) an open position in which the upper portion does not engage substantially all of the sides;

a product holding platform at least partially within the housing and configured to hold product;

a biasing device engaged to the product holding platform and configured to bias the product holding platform away from the bottom; and a dispensing mechanism comprising two vertically oriented shafts and configured to manage vertical movement of the product holding platform along a vertical length between the top and the bottom, wherein each of the vertically oriented shafts comprises a plurality of retention devices each disposed along a length of the respective shaft at a different vertical positions and in vertical alignment, and wherein:

in response to the upper portion being in the open position, each of the plurality of retention devices is configured to move to a first position to sequentially engage the product holding platform at its respective vertical position as the product holding platform moves up and down along the vertical shafts to (i) permit the product holding platform to move unobstructed down past its respective vertical position and (ii) prevent the biasing device from moving the product holding platform up above its respective vertical position once the product holding platform has been moved below its respective vertical position, and in response to the upper portion being in the closed position, each of the plurality of retention devices is configured to move to a second position to disengage from the product holding platform to permit the product holding device to be moved up by the biasing device unobstructed above its respective vertical position, wherein the two vertical shafts rotate around vertical axes to move the pluralities of retention devices from the first position to the second position and back.

12. The dispensing system of claim 11, wherein each of the pluralities of retention devices is a protrusion from the respective vertical shaft and has a ramp shape with a sloped top surface and a flat bottom surface, wherein the sloped top surface extends away from the respective vertical shaft.

13. The dispensing system of claim 12, wherein the product holding platform has a horizontal engagement device on each end, proximate the respective vertical shaft, that, when in the first position, retracts inwardly as the product holding platform moves down across the respective sloped top surface and extend back outwardly as product holding platform moves down past the sloped top surface to the flat bottom surface.

* * * * *